United States Patent [19]

Grant

[11] Patent Number: 4,657,159

[45] Date of Patent: Apr. 14, 1987

[54] MENISCUS-SHAPED CONTAINER

[76] Inventor: Alan H. Grant, 3208 Woodhollow Dr., Chevy Chase, Md. 20015

[21] Appl. No.: 762,827

[22] Filed: Aug. 6, 1985

[51] Int. Cl.[4] ..... B67B 7/24

[52] U.S. Cl. ..... 222/83; 222/107; 222/213; 222/556; 206/634

[58] Field of Search ..... 222/80–81, 222/83, 206, 212–215, 541, 544, 556, 107, 78, 175; 206/77.1, 277, 603, 530–531, 828; 220/DIG. 13

[56] References Cited

U.S. PATENT DOCUMENTS

| | | | |
|---|---|---|---|
| 3,154,074 | 10/1964 | Harrison | 222/92 X |
| 3,172,130 | 3/1965 | Lange | 220/DIG. 13 |
| 3,215,319 | 11/1965 | Laker | 222/478 X |
| 4,037,790 | 7/1977 | Reiser et al. | 222/175 X |
| 4,072,233 | 2/1978 | Kramer et al. | 206/634 |
| 4,109,836 | 8/1978 | Farlarde | 222/494 |
| 4,153,185 | 5/1979 | Nilson | 222/212 |

*Primary Examiner*—Joseph J. Rolla
*Assistant Examiner*—Michael S. Huppert
*Attorney, Agent, or Firm*—Berman, Aisenberg & Platt

[57] ABSTRACT

A container is provided which has a meniscus shape. A convex part is received in the pale of a user's hand, and a lid is forced into a concave region to dispense material stored in the concave region. An opening which is easily opened and closed for dispensing material is made by using a dispensing aperture and a projection. When the projection is forced into the aperture, the container is closed, and when the projection is removed, the aperture is opened to allow material to be dispensed. Manipulation of the projection is simplified by the use of a lever easily engaged by a user's thumb. Dispensing is accomplished by holding the device in a user's palm so that the convex part lies across the palm and the fingers engage the lid. Normal action of the user's fingers causes the lid to be squeezed inwardly from the bottom to the top to efficiently expell the stored material. The container may be manufactured as a single unit in an unfolded condition, and it is then only necessary to place material in the concave region and to fold the lid over the concave region to complete assembly.

8 Claims, 5 Drawing Figures

FIG 1
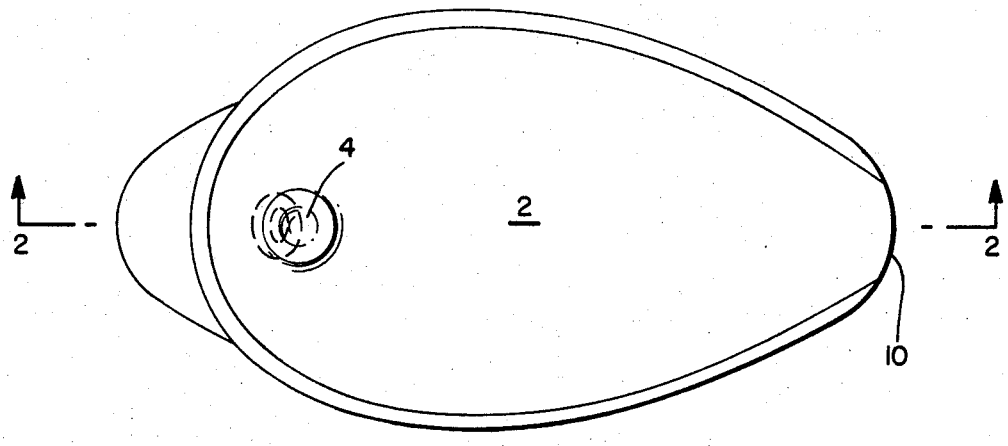
FIG 2
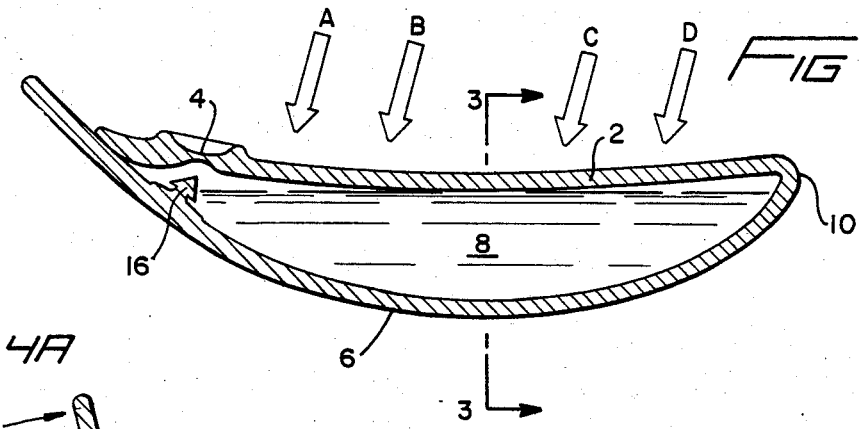
FIG 4A
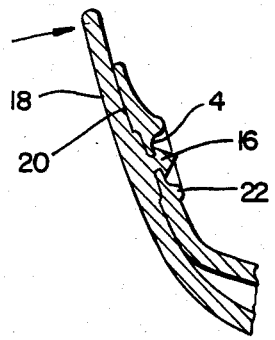
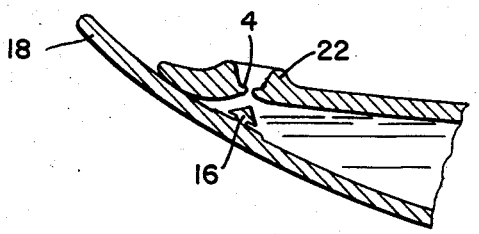
FIG 4B
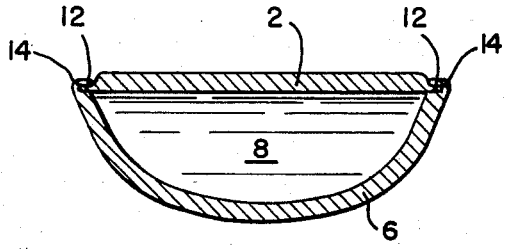
FIG 3

MENISCUS-SHAPED CONTAINER

TECHNICAL FIELD

This invention relates to the art of containers. In particular, the container is hand-held and is uniquely shaped for easily dispensing material.

BACKGROUND ART

Many containers are known which are hand-held and provide for dispensing material by squeezing the container. In the familiar toothpaste tube, a tube is made of flexible material having an opening at one end. The material is dispensed by squeezing the tube to force material out of the opening. Typically, the tube is either rolled from a bottom crimp or flattened upwardly from the bottom crimp. If the tube is held in the palm of one's hand and simply squeezed, some of the material is forced out of the opening and some of the material is forced toward the end opposite the opening.

U.S. Pat. No. 3,154,074 (Harrison) shows a medicine dispenser having a narrow projection extending from a cavity which is covered by a flexible sheet. Material is forced from one end of the projection by pressing the flexible sheet into the cavity to displace the material. U.S. Pat. No. 4,109,836 (Falarde) shows a container wherein a dispensing neck is wound in a spiral when the contents of the container are not under pressure. When the contents are placed under pressure, a slit in the neck opens and allows material to be dispensed.

SUMMARY OF THE INVENTION

The devices known in the prior art are difficult to use in that they require manipulation contrary to a natural action of a human hand. The container in accordance with the invention is ergonomically designed to be easily used with one hand and is of simple construction to reduce manufacturing costs.

The inventive container has a receptacle which provides a concave cavity for receiving material and which has a convex outer part designed to be held in the palm of a human hand. A lid is attached to the receptacle and covers the concave cavity to seal the container. The lid is moveable with respect to the concave cavity so that when the convex portion is placed in a user's palm, the fingers easily engage the lid. Material is dispensed by pressing the lid into the concave cavity with the user's fingers to cause material to be expelled from an opening. Because the convex part fits in a human palm and lies adjacent the fingers extending from the little finger to the index finger, the lid is easily pressed into the cavity. When the fingers are squeezed in a natural motion which ordinarily forms a fist, the fingers engage the lid of the container and force it into the concave cavity of the lower part to the expel the material. The normal sequence instinctively followed by a human hand is to apply pressure first by the little finger, then by the ring finger, the middle finger, and then the index finger. Since the end of the container lies adjacent the little finger, this normal sequence of pressures causes the material in the container to be expelled in an orderly manner.

The outlet of the container in accordance with the invention is designed to operate easily while the container is held in the user's palm. The lid has a dispensing aperture, and the bottom part has a projection which extends through the aperture when the container is closed and is removed from the aperture to open the container. Integral with the lower part is a lever which cooperates with the lid to pull the projection from the dispensing aperture during the opening operation.

An object of this invention is to provide a container which is designed to cooperate ergonomically with the normal action of the human palm.

Another object of this invention is to provide a container which is easily used by simply squeezing it between a user's palm and fingers.

Yet another object of this invention is to provide a container having a unique dispensing mechanism which is easily operated.

BRIEF DESCRIPTION OF THE DRAWINGS

FIG. 1 is a top view of the container in accordance with the invention.

FIG. 2 is a cross section taken along line 2—2 of FIG. 1.

FIG. 3 is a cross-section taken along line 3—3 of FIG. 2.

FIG. 4*a* is a partial cross section of the container shown in FIG. 1 along lines 2—2 showing the dispensing aperture closed.

FIG. 4*b* is a partial cross section taken along line 2—2 of FIG. 1 showing the dispensing aperture in a sealed condition.

DETAILED DESCRIPTION OF THE DRAWINGS

FIG. 1 is a top view of a container in accordance with the invention which includes a lid 2 and a dispensing aperture 4. FIG. 2 shows the container of FIG. 1 in cross section taken along line 2—2 of FIG. 1. A lower part 6 is a receptacle and provides a concave region 8 for holding material. The concave region 8 is covered by lid 2 to form a sealed enclosure as will be described below. Lid 2 is attached to the lower part 6 at a hinge 10 to facilitate manufacture of the container.

Lower part 6 has a convex outer curvature which is shaped to fit in the palm of a user's hand when the container extends transversely across the hand. Lid 2 is curved to cooperate with the lower part 6 in a manner which will be described below and the container has a meniscus shape overall.

When the container is manufactured, the lid 2 may be rotated approximately 180 degrees about hinge 10 from the position shown in FIG. 2 so that concave region 8 is exposed. Material to be stored is placed in concave region 8 and then the lid 2 is folded over to a position such as that shown in FIG. 2 to close the container. This is an efficient method of producing the inventive container because it may be molded in a single step in the open position and then simply folded over after the concave region 8 has been filled with any of a wide variety of materials, such as toothpaste.

FIG. 3 is a cross section taken along line 3—3 of FIG. 2 and illustrates one method for securing the lower part 6 to lid 2. Lid 2 preferably includes a lip 12 which is received in a groove formed by a folded over part 14 of the upper edge of lower part 6. Of course, a wide variety of techniques for securing lid 2 to lower part 6 may be employed.

With reference to FIGS. 2, 4*a* and 4*b*, the opening which allows material to be dispensed will be described. FIG. 2 shows an initial condition wherein a dispensing aperture 4 is closed and is located adjacent an internal projection 16. The dispensing aperture 4 is manufactured in a sealed state, to provide a tamper-proof container. If the aperture 4 has been opened, this will be immediately apparent to a user.

FIG. 4*a* shows the condition when the internal projection 16 has been forced through the dispensing aperture 4 so as to puncture the seal. For example, when a new container is opened, the pointed internal projection 16 is forced through the dispensing aperture 4 to break the seal so that material may be dispensed. The internal projection 16 includes an arrowhead portion to hold it in a closed position such as that shown in FIG. 4*a* wherein the internal projection closes the dispensing aperture 4 to prevent material from being dispensed.

FIG. 4*b* shows the container in an open position after the seal has been broken and the internal projection has been removed from the dispensing aperture 4. A lever portion 18 is integral with the lower part 6 and may be easily manipulated by a user's thumb to open the container. That is, when the thumb is pressed against the opening lever 18 as shown by the arrow in FIG. 4*a*, the internal projection will rotate about the connection between the lever 18 and the lid 2 at region 20 to pull internal projection 16 out of dispensing aperture 4 to result in the configuration shown in FIG. 4*b*.

The container is then closed by placing the thumb adjacent internal projection 16 and squeezing the dispensing aperture toward the internal projection to a configuration such as that shown in FIG. 4*a*.

The dispensing aperture 4 preferably has a ridge 22 surrounding it to provide additional strength to allow dispensing aperture 4 to be initially covered by a thin seal.

Operation of the inventive container will be described with respect to FIG. 2. Arrows labled A, B, C, and D illustrate the locations and directions of forces applied by the fingers of a user. When lower part 6 is placed in the user's palm, the user's fingers will naturally lie in the location shown by the letters A through D in FIG. 2. Then, when the fingers squeeze toward the palm, forces will be applied as illustrated by the arrows A through D. The meniscus shape of the inventive container is specifically designed to take advantage of the natural tendency to begin the squeezing force initially with the little finger so that force is initially applied as shown by arrow D. Then, as squeezing continues, additional forces are applied. The ring finger will apply force in the direction of arrow C, the middle finger will apply force in the direction of arrow B, and the index finger will then apply force as indicated by arrow A. It will be appreciated that this sequence of forces causes the material in region 8 to be dispensed from the bottom of the container upwardly toward the dispensing aperture 4, thus resulting in efficient dispensing of the material.

Lid 2 is preferably made of a flexible material to allow it to be pressed into region 8. Lid 2 will usually be less flexible than lower part 6, but this is not necessary to the operation of the device. Furthermore, lid 2 and lower part 6 could have similar flexibilities.

Modifications of the invention within the scope of appended claims will be apparent to those of ordinary skill in the art.

What is claimed is:

1. A container comprising a receptacle forming a concave part for receiving material and having a curved outer surface, and a lid covering said receptacle, wherein said lid is flexible and connected to said receptacle, said curved outer surface is of a size and shape to conform generally to a cupped human palm and to extend completely across said palm, said lid has a concave upper surface whereby it may be forced into said concave part by a user's fingers when said curved outer surface is in a cupped human palm for moving said material across said palm and expelling said material in response to sequential forces applied by said user's fingers, said concave part is wider in cross-section at a central region and tapers at opposed ends, and dispensing means for dispensing said material is located at one of said opposed ends.

2. A container according to claim 1 wherein said receptacle is less flexible than is said lid.

3. A container according to claim 1 wherein said dispensing means comprises means forming an opening and plug means for selectively blocking said opening, said means forming an opening cooperating with said concave part for allowing said material to be dispensed when said plug means does not block said opening.

4. A container according to claim 3 wherein said plug means extends outwardly from an edge part of said receptacle and said means forming an opening is an upper edge part of said lid.

5. A container according to claim 4 wherein said plug means includes retaining means for selectively retaining said plug means in a blocking position in said opening.

6. A container according to claim 5 wherein said edge part of said receptacle extends beyond the location of said plug means to form a lever and a part of said upper edge of said lid lies adjacent said lever when said plug is in said blocking position whereby said plug may be moved from said blocking position by pressing on said lever to force said upper edge of said lid away from said plug means.

7. A container according to claim 4 wherein said opening is covered with a membrane which is adapted to be punctured when said plug is moved to a blocking position.

8. A container according to claim 1 wherein said lid is connected to said receptacle by a hinge means whereby said lid may be pivoted from a first position not covering said concave part to a second position covering said concave part.

* * * * *